US011687037B2

(12) United States Patent
Hinaux et al.

(10) Patent No.: US 11,687,037 B2
(45) **Date of Patent: *Jun. 27, 2023**

(54) WATCH WINDING AND TIME-SETTING DEVICE

(71) Applicant: The Swatch Group Research and Development Ltd, Marin (CH)

(72) Inventors: Baptiste Hinaux, Lausanne (CH); Jérôme Favre, Neuchâtel (CH)

(73) Assignee: The Swatch Group Research and Development Ltd, Marin (CH)

( * ) Notice: Subject to any disclaimer, the term of this patent is extended or adjusted under 35 U.S.C. 154(b) by 894 days.

This patent is subject to a terminal disclaimer.

(21) Appl. No.: 16/684,876

(22) Filed: Nov. 15, 2019

(65) Prior Publication Data

US 2020/0166891 A1 May 28, 2020

(30) Foreign Application Priority Data

Nov. 26, 2018 (EP) ..... 18208249

(51) Int. Cl.
*G04B 27/02* (2006.01)
*G04B 5/02* (2006.01)
(Continued)

(52) U.S. Cl.
CPC ..... *G04B 27/02* (2013.01); *G04B 3/006* (2013.01); *G04B 5/002* (2013.01); *G04B 5/02* (2013.01);
(Continued)

(58) Field of Classification Search
CPC ..... G04B 27/02; G04B 3/006; G04B 5/002; G04B 7/00; G04B 5/02; G04D 7/009; G04D 7/1264; G04C 1/04
See application file for complete search history.

(56) References Cited

U.S. PATENT DOCUMENTS 5,988,871 A * 11/1999 Bonnet ..... G04B 3/006 81/7.5
7,167,417 B2 * 1/2007 Akahane ..... G04R 60/14 368/155
(Continued)

FOREIGN PATENT DOCUMENTS

CH 711 099 A2 11/2016
DE 10 2013 012 854 B3 5/2014
(Continued)

OTHER PUBLICATIONS

European Search Report for EP 18 20 8249 dated May 3, 2019.

*Primary Examiner* — Renee S Luebke
*Assistant Examiner* — Sean R Brannon
(74) *Attorney, Agent, or Firm* — Sughrue Mion, PLLC

(57) ABSTRACT

A device (1000) for the winding and time-setting of a watch (1) with an oscillating resonator (2), which includes: an automatic winding mechanism (304) for a mechanical or automatic watch, which includes at least one watch reception support (305), a viewing system (1002), a stoppage monitor (500) to observe the stoppage of a resonator (2), and a controller (900) arranged to identify the stoppage time displayed by the watch (1) in the stoppage position thereof, to compute the time remaining until a synchronization between the actual time indicated by the clock (1001) and the stoppage time, and, when the remaining time has elapsed, to activate the automatic winding mechanism (304) for rewinding the power storage device of the watch (1).

16 Claims, 5 Drawing Sheets

(51) Int. Cl.

| | |
|---|---|
| ***G04B 7/00*** | (2006.01) |
| ***G04B 3/00*** | (2006.01) |
| ***G04B 5/00*** | (2006.01) |
| ***G04C 1/04*** | (2006.01) |
| ***G04D 7/00*** | (2006.01) |
| ***G04D 7/12*** | (2006.01) |

(52) U.S. Cl.
CPC ..... *G04B 7/00* (2013.01); *G04C 1/04* (2013.01); *G04D 7/009* (2013.01); *G04D 7/1264* (2013.01)

(56) References Cited

U.S. PATENT DOCUMENTS

| | | | | |
|---|---|---|---|---|
| 10,095,189 | B2 * | 10/2018 | Masserot | G04G 5/00 |
| 2005/0105401 | A1 * | 5/2005 | Akahane | G04R 20/00 368/187 |
| 2005/0254352 | A1 * | 11/2005 | Wolf V | G04D 7/009 368/206 |
| 2006/0239124 | A1 * | 10/2006 | Thumm | G04B 45/02 368/88 |
| 2014/0003200 | A1 * | 1/2014 | Lamarche | G04B 7/00 368/47 |
| 2018/0181075 | A1 | 6/2018 | Born et al. | |
| 2020/0166894 | A1 * | 5/2020 | Hinaux | G04B 5/00 |

FOREIGN PATENT DOCUMENTS

| | | | |
|---|---|---|---|
| EP | 3 339 984 | A1 | 6/2018 |
| WO | 2012/126978 | A1 | 9/2012 |

* cited by examiner

WATCH WINDING AND TIME-SETTING DEVICE

CROSS REFERENCE TO RELATED APPLICATIONS

This application claims priority to European Patent Application No. 18208249.5, filed on Nov. 26, 2018, the entire contents of which are incorporated herein by reference.

FIELD OF THE INVENTION

The invention relates to a universal device for the winding and time-setting of a watch comprising an oscillating resonator arranged to generate an oscillation at a nominal frequency, said universal device comprising means for rewinding and correcting the state of said watch, comprising an automatic winding mechanism for a mechanical or automatic watch which comprises at least one watch reception support, said universal device comprising state measurement means for measuring the state of said watch relative to a reference clock to which refer said state measurement means which comprise a viewing system.

The invention further relates to a watch bank comprising such a universal winding and time-setting device, and at least one said watch comprising a time base comprising at least one oscillating resonator, state correction means by means of a control rod provided with a state adjustment organ accessible to the user, power storage means or at least one barrel, and power recharging means.

The invention further relates to a method for adjusting the state of a watch.

The invention relates to the field of watch maintenance, and devices for quickly providing the user with a watch from their collection, with an updated state setting, a satisfactory running setting, and full power recharge.

BACKGROUND OF THE INVENTION

Current winding mechanisms use a conventional gear between an electric motor and a watch support. This type of transmission is sufficient for continuous rotation, in an economical production at reduced costs, and at low consumption. However, if such a winding mechanism is used for relatively rapid to-and-fro movements, in particular dither, which consists of subjecting the watch to vibrations, by moving with modulated, in particular periodical, adjustment movement, up to a frequency of 10 Hz or more, shock noises are liable to occur, and cause discomfort for the user.

Document DE 10 2013 012854 B3 held by GODER describes a watch support device with synchronisation, wherein the running of the watch is detected and corrected automatically by means of the running deviation of the watch according to the position, preferably adopting suitable positions. In an alternative embodiment, the running analysis is carried out according to the temperature. In a further alternative embodiment, the running analysis is carried out in correlation with the degree of winding of the driving spring of the watch.

Document U.S. Pat. No. 5,988,871 A held by BONNET describes a mechanical watch winding mechanism apparatus, which comprises a case, a wrist-sized chuck, the watch being placed and kept in the case. A claw mechanism grips the crown of the watch, and is driven by an electric motor. The claws pivot the crown of the watch to rotate same automatically by a predetermined value, and at regular intervals. A control circuit adjusts the frequency at which the watch is rewound, as well as the duration during which the claws are driven by the motor whenever the watch is wound.

Document DE10 2008 032124 held by GEHRING describes a device for setting a watch, comprising action means for acting externally upon the watch to set the data and the functions thereof, some of these action means are mechanical action means for acting mechanically upon mechanical interfaces of the watch, such as buttons and/or crowns.

A dither method is described by patent applications CH713821 or EP3410235, and CH713822 or EP3410236, of the same applicant, relating respectively to the running adjustment and state correction or a movement or of a watch, and is very advantageous for the correction of slight drifts, for example of the order of a few tens of seconds in one day. However, it does not yet enable correction in less than one day of a state error greater than more or less one minute, for example for time setting after stoppage, or changing to summertime or wintertime, for example.

Application CH00624/18, or EP3422119, of the same applicant, relates to a universal watch preparation device, and uses the teachings of the above-mentioned patent applications relative to dither.

There is further known, essentially for clocks, Breguet Sympathique Clock type systems, which are only suitable for the time setting of specific watches, by means of a mechanical interaction with a specific interface.

Finally, if the minute and second hands are poorly indexed in relation to one another, the information can currently be reported to the Client, but the indexing cannot be corrected.

SUMMARY OF THE INVENTION

The invention proposes to set the time of an automatic oscillating watch using a device/apparatus/support. The device enables the winding of the watch, but the principle of the invention is that of only starting when the watch actually displays the current time.

For this purpose, the invention relates to a universal device for the winding and time-setting of a watch according to claim 1.

The invention further relates to a watch bank according to claim 12.

The invention further relates to a method for adjusting the state of a watch according to claim 16.

BRIEF DESCRIPTION OF THE DRAWINGS

Further features and advantages of the invention will emerge on reading the following detailed description, with reference to the appended drawings, where:

in FIG. 4, a first removable cap suitable for a first crown of the watch is identified;

in FIG. 5 this first crown is pulled;

in FIG. 6 the first crown is equipped with this first removable cap;

in FIG. 7 the watch is placed on a support;

DETAILED DESCRIPTION OF PREFERRED EMBODIMENTS

Figure 1:
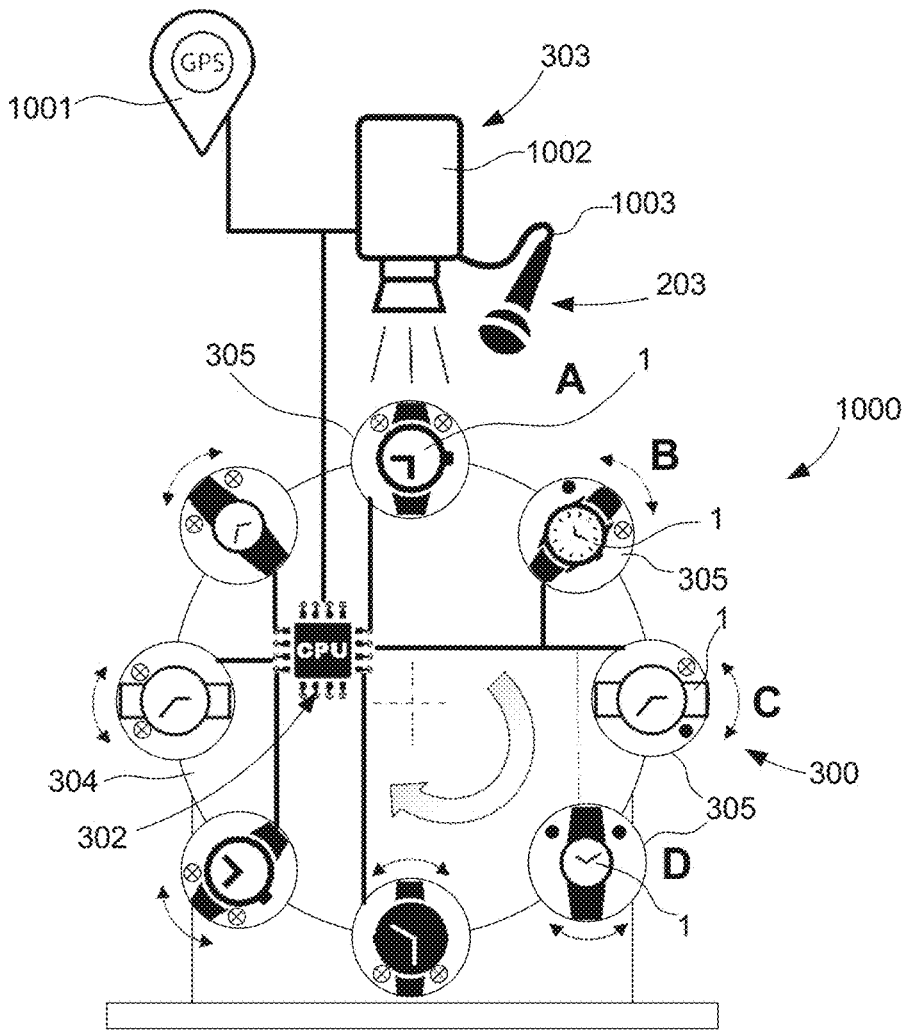
FIG. 1 represents, schematically, and in a front view, a portion of a universal winding and time-setting device according to the invention, which comprises a winding mechanism which supports a plurality of different watches mounted on the same device, each on a support suitable for at least an oscillation movement, particularly with pivoting; this winding mechanism comprises state measurement means with particularly a fixed viewing system for assessing the state of each watch, and suitable for comparing the time read to a reference clock, herein illustrated by a GPS link; this winding mechanism further comprises a microphone for assessing the frequency and running of the watch; this winding mechanism is a rotary winding mechanism, suitable for bringing successively each watch opposite the viewing system and the microphone, which are herein unique in this particular embodiment.
Figure 2:
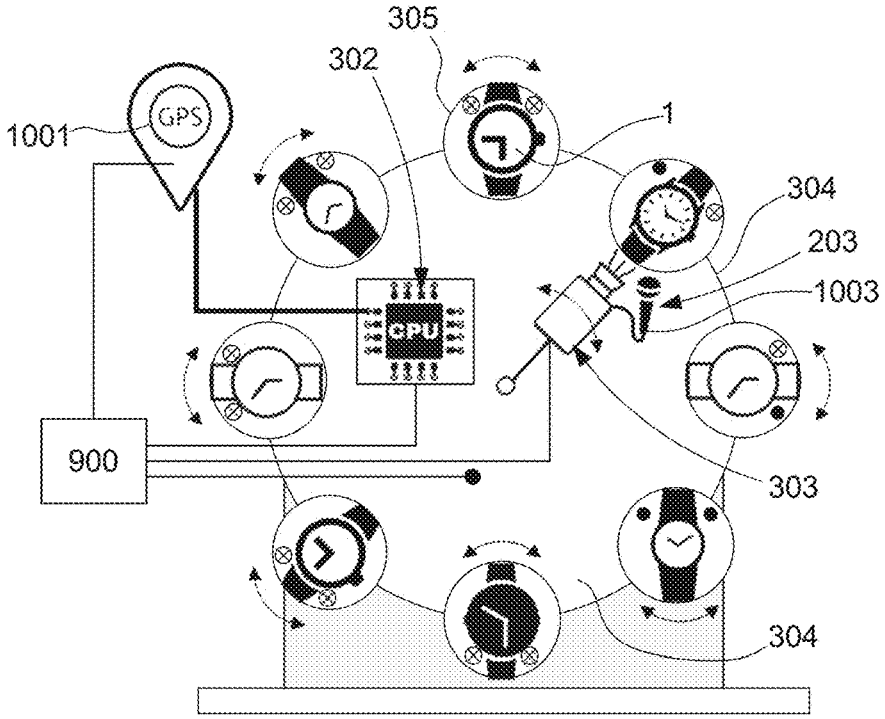
FIG. 2 represents, similarly to FIG. 1, a winding mechanism wherein the viewing system and the microphone are mobile, and where the supports are in a fixed position; control means collect the data from the sensors on the running of the watches, on the state thereof, in order to set the automatic winding mechanism in motion at the suitable time.
Figure 3:
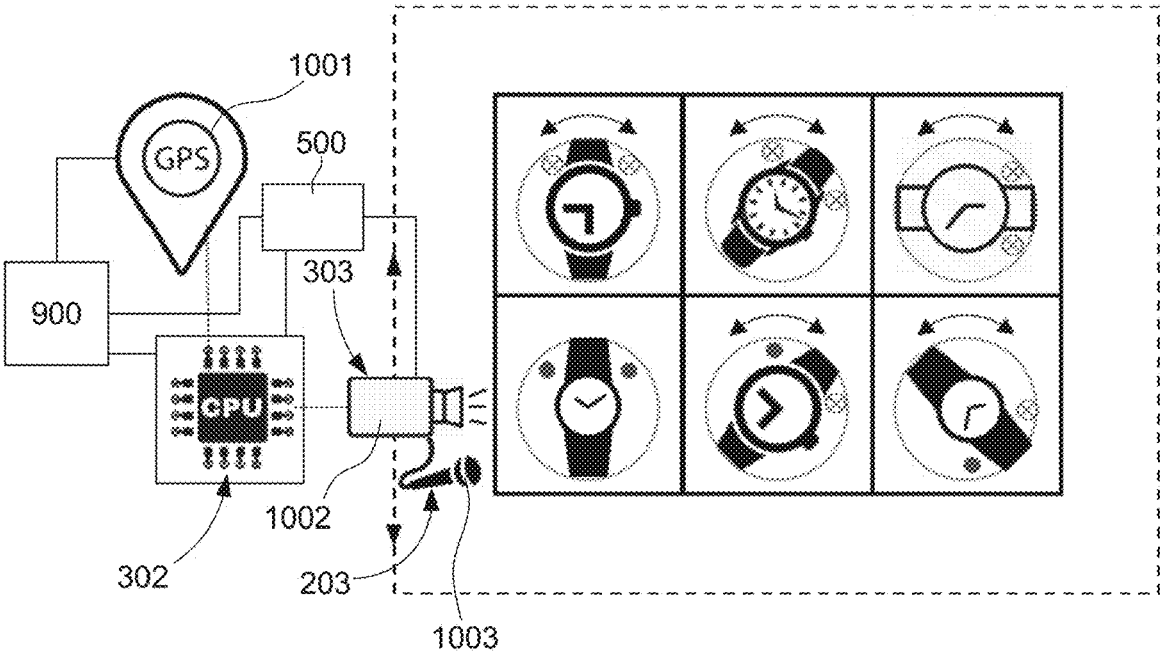
FIG. 3 represents, similarly to FIG. 2, a further winding mechanism wherein the viewing system and the microphone are mobile, and where the supports are in a fixed position.
Figure 4:
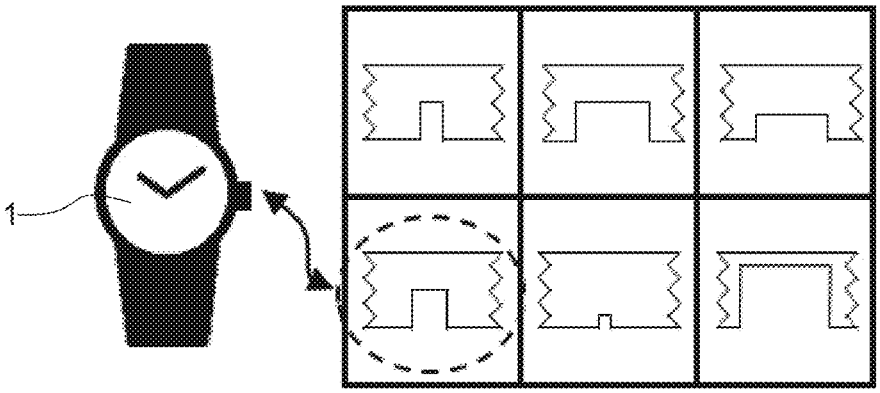
FIGS. 4 to 7 illustrate the steps of a method for setting the state of a watch, with a further portion of the universal winding and time-setting device, which comprises a robotic manipulator, and whereby.
Figure 5:
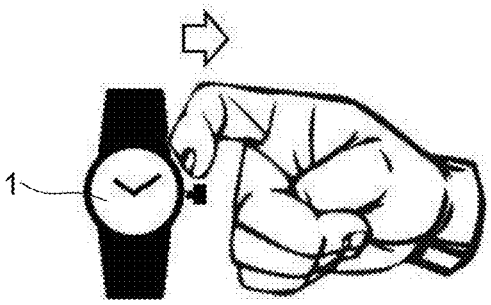
Figure 6:
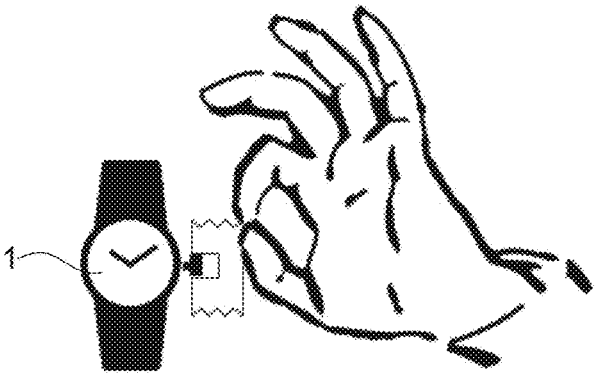
Figure 7:
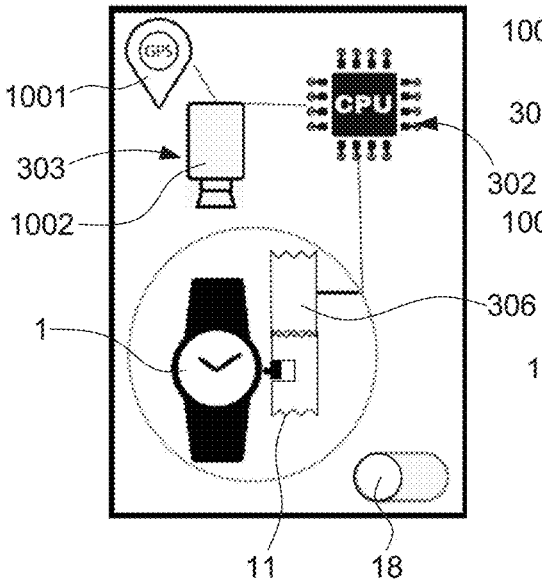
Figure 8:
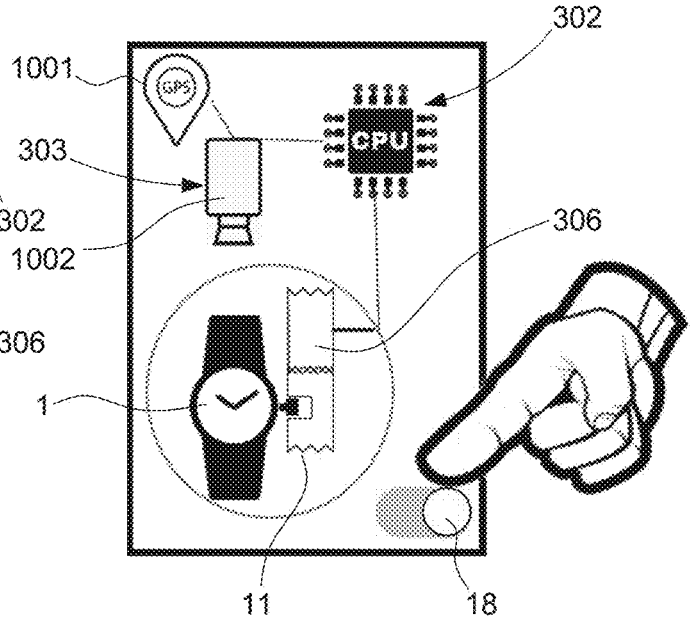
in FIG. 8 an action is performed on a control means to activate the state measurement means and measure the state of the watch.
Figure 9:
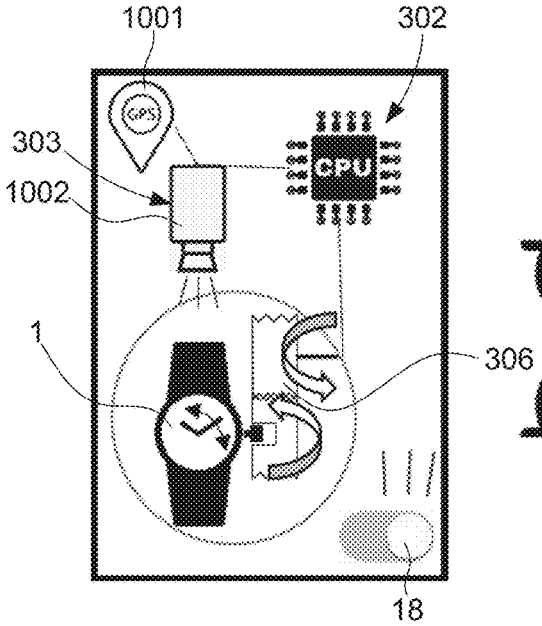
in FIG. 9 the state of the watch is adjusted by a robotic manipulator controlled by said state control means, and which manipulates this first removable cap.
Figure 10:
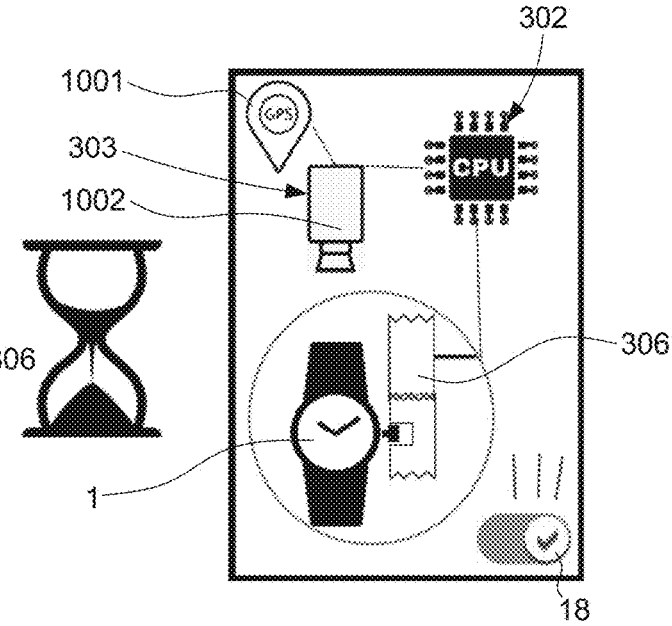
in FIG. 10, after a certain time, the user is informed, optionally, of the completion of the setting of the state of their watch by a signal at the level of the control means.
Figure 11:
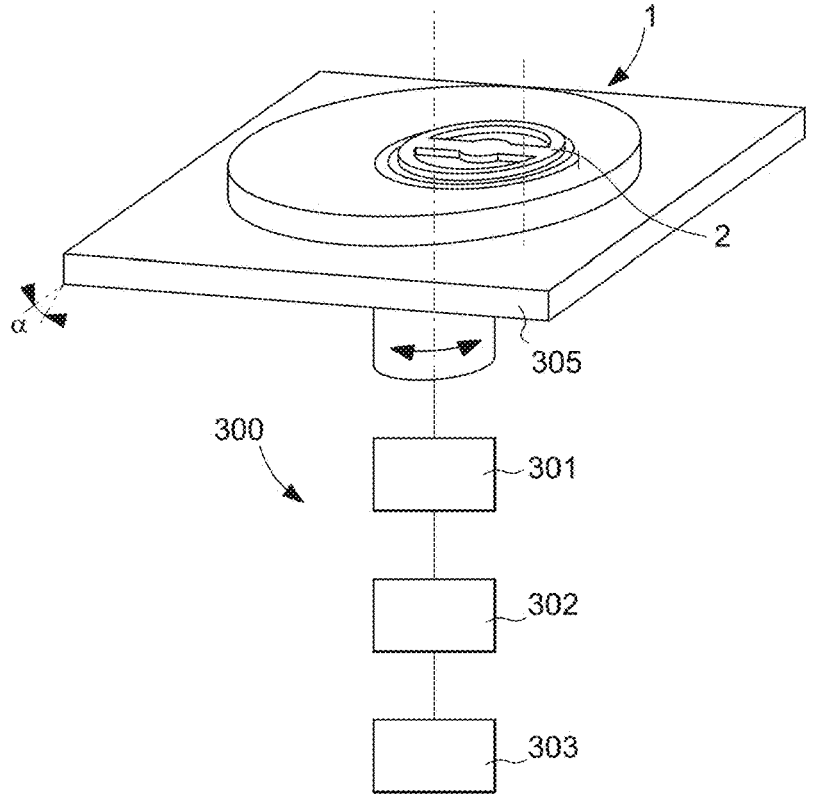
FIG. 11 represents, in a schematic, partial, perspective view, the oscillator of a watch held on a support, subject to the action of a state correction device which comprises state control means for controlling a state correction oscillator arranged to generate an oscillation at a correction frequency, and subjecting the watch to an oscillation at this correction frequency and/or to a modulated movement, the state correction device comprising state control means arranged to control the oscillation of the state correction oscillator and interfaced with state measurement means for measuring the state of the watch.
Figure 12:
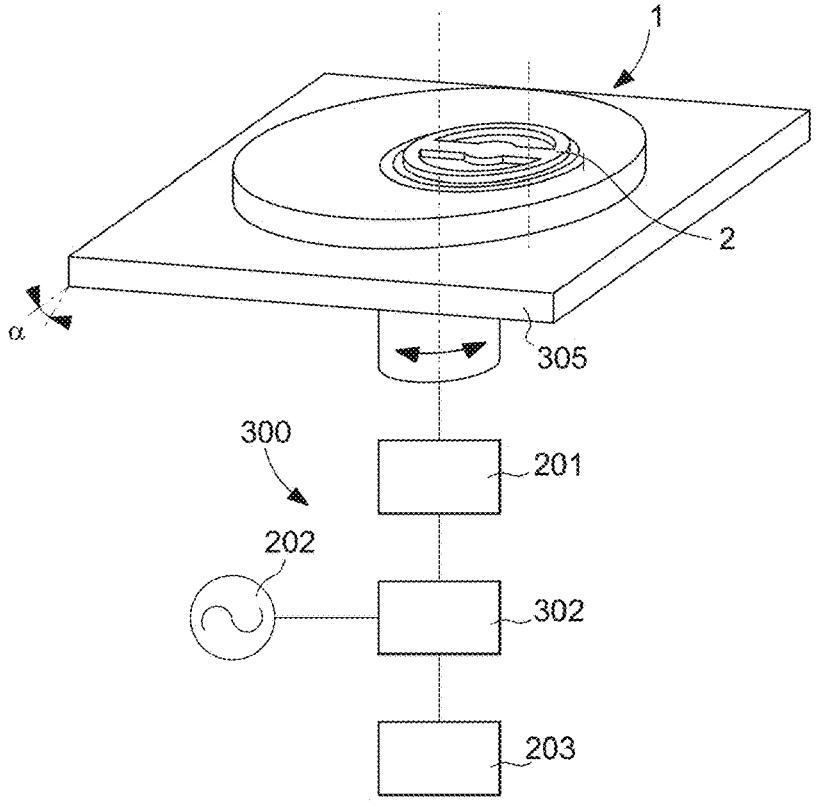
FIG. 12 represents, in a schematic, partial, perspective view, the oscillator of the watch in FIG. 11, where the state control means are further arranged to control an excitation oscillation generated by a master oscillator at an excitation frequency, approximately equal to the nominal frequency of the oscillator of the watch, or to a whole multiple thereof, and which are interfaced with running measurement means for measuring the running deviation of the watch.
Figure 13:
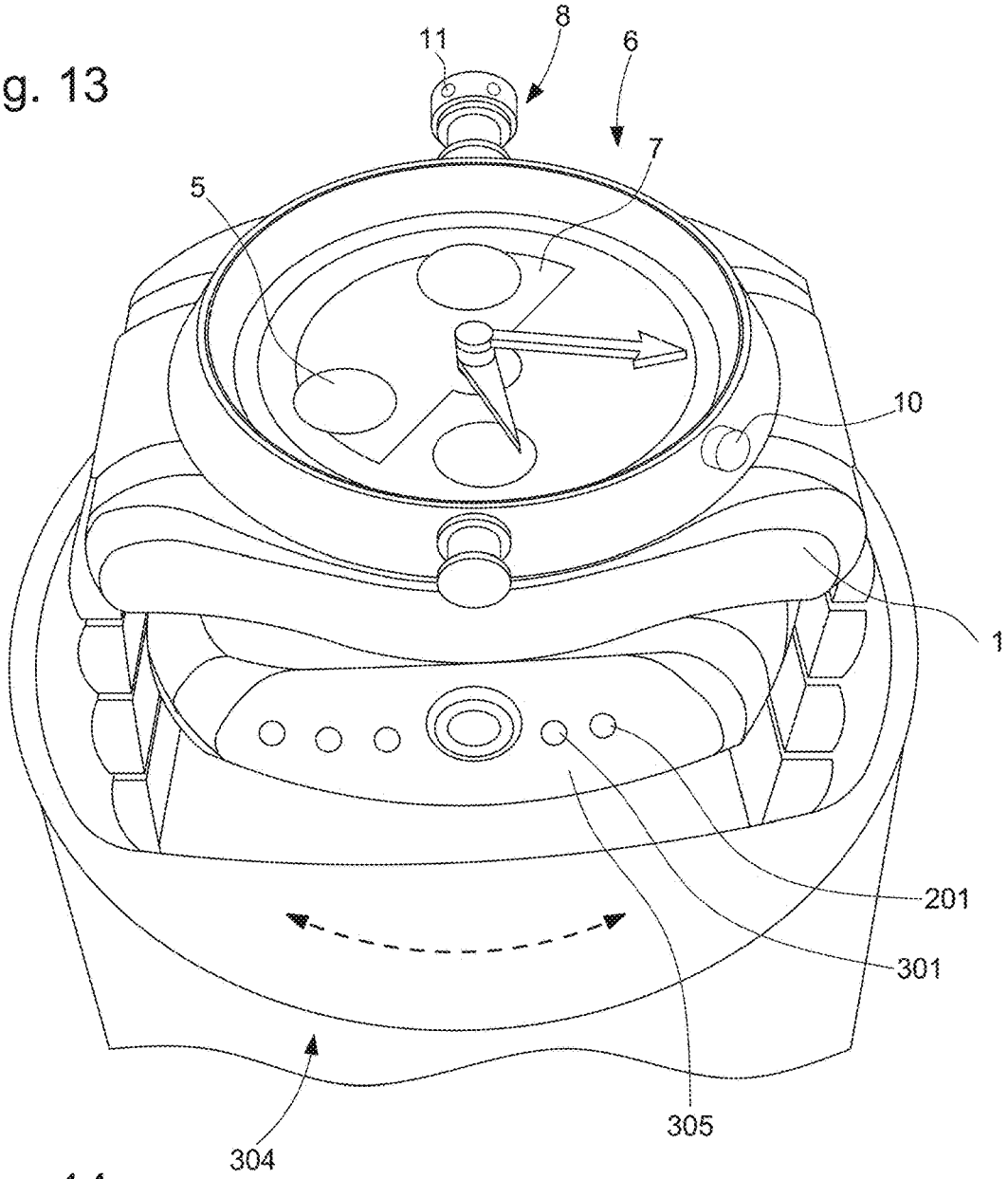
FIG. 13 represents, in a schematic, partial, perspective view, set on a support, a watch which comprises a barrel and an automatic rewinding mass, a first state correction crown comprising a handling groove, a second rewinding crown comprising a handling groove and herein equipped with a second removable cap arranged to cap same with gripping to allow the handling thereof by a robotic manipulator, and an actuator also suitable for handling by a motorised manipulator.
Figure 14:
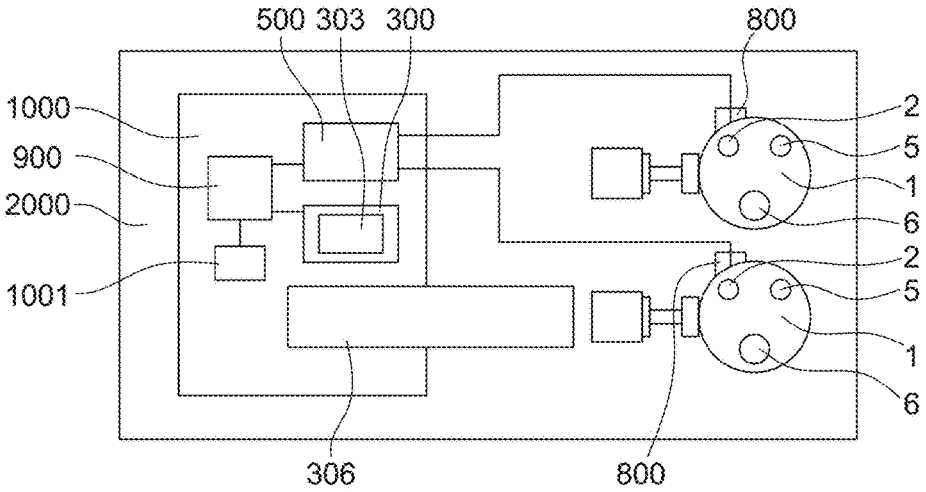
FIG. 14 represents, in the form of a block diagram, a watch bank, which comprises such a universal winding and time-setting device, and watches each comprising an oscillating resonator time base, with running checking means disposed in the vicinity of each resonator, state correction means by means of a control rod provided with a first crown, power storage means or a barrel, power recharging means, particularly arranged completely or partially in the manner of the watch represented in FIG. 13.

Patent applications CH713821 or EP3410235, and CH713822 or EP3410236, of the same applicant, describe a smart winding mechanism suitable for slaving the frequency of at least one mechanical watch. Different embodiments have been envisaged, in particular alternative embodiments suitable for slaving a plurality of watches on the same device, which represents a recurrent demand from watch enthusiasts and collectors.

Naturally, the description provided herein for a watch, in the particular aim of an embodiment of the invention by a user, is applicable to an uncased movement, in a factory or servicing department. The term "watch" is therefore used by simplification, equally well for a complete watch as for the movement thereof alone.

The invention, preferably to be included in a winding mechanism, is intended to stop the watch, or at least allow the watch to stop, using the natural discharge of the barrel when it is immobile, before winding same to restart it when the current time matches the time displayed.

Application CH713821 or EP3410235 describes a device for winding an automatic watch as well as measuring the winding level thereof. Therefore, it particularly makes it possible to measure or check the stoppage thereof.

Once the watch has stopped, the device stops the winding activity thereof until the information displayed by the watch matches the current time. Thus, for a watch only displaying the time in the twelve-hour format, with two or three hands, the maximum duration for time setting is the total power reserve thereof and twelve hours. For example, for a change to summertime (going forward one hour), the time required is the total power reserve thereof and eleven hours.

For a watch displaying the date, it is possible to set the time within a maximum duration which is the total power reserve thereof and twenty-four hours at most, provided that the watch is equipped with a quick date setting and that this setting is left up to the client. As a general rule, the maximum time required for time setting with this device is equal to the total power reserve, on one hand, and, on the other, the period at which the dial indications return to the same position, with the exception of those left up to the client to set.

The majority of watches have a power reserve between 30 and 80 hours, and have a display in twelve-hour format, without the date, or with quick date setting, therefore the time is set in a few days, which corresponds well to the occasional use of users possessing winding mechanisms.

When an automatic watch is stopped, the exact time that it is restarted by means of rotary movements is poorly known. Further, with an almost empty barrel, the running of the watch is frequently not as good as with a full barrel. Thus, this time-setting device is liable to cause running errors of a few seconds.

Therefore, it is advantageously associated with the fine state setting described in applications CH713822 or EP3410236, and CH00624/18 or EP3422119, the content whereof is incorporated herein by way of reference.

Furthermore, this procedure requires knowledge of the time displayed by the watch, as described in the above-mentioned applications.

More particularly, the invention relates to a universal device 1000 for the winding and time-setting of a watch 1 comprising an oscillating resonator 2. This resonator 2 is arranged to generate an oscillation at a nominal frequency NO.

The universal device 1000 comprises means for rewinding and correcting the state of the watch 1, which comprise an automatic winding mechanism 304 for a mechanical or automatic watch, which comprises at least one watch reception support 305.

The universal device 1000 comprises state measurement means 303 for measuring the state of the watch 1 relative to a reference clock 1001, to which refer these state measurement means 303, which comprise a viewing system 1002.

According to the invention, the universal device 1000 comprises stoppage monitoring means 500, which are arranged to observe the stoppage or running of such an oscillating resonator 2 of a watch 1. Also, the universal device 1000 comprises control means 900, which are arranged, upon observation of a stoppage by the stoppage monitoring means 500, to identify, according to data transmitted by the state measurement means 303, the stoppage time displayed by the watch 1 in the stoppage position thereof. These control means 900 are further arranged to compute the time remaining until a next synchronisation time between the actual time indicated by the reference clock 1001 and this stoppage time, and to, when this remaining time has elapsed, activate the automatic winding mechanism 304 for rewinding the power storage means of the watch 1, and thus allow the restart thereof.

More particularly, the universal device 1000 comprises at least one state correction device 300 for correcting the state of the watch 1.

This state correction device 300 comprises this automatic winding mechanism 304, the support 305 whereof is subjected to the oscillations or movements generated by a state correction oscillator 301. This state correction oscillator 301 is arranged to generate an oscillation at a correction frequency NC, and to subject the watch 1 to an oscillation at the correction frequency NC and/or to a modulated movement.

The state correction device 300 further comprises state control means 302, which are arranged to control the oscillation of the state correction oscillator 301, and which are interfaced with the state measurement means 303.

Advantageously, the universal device 1000 comprises running monitoring means 800 of such an oscillating resonator 2. Also, in the event of activation of the automatic winding mechanism 304, the control means 900 are arranged to await the determination of the stabilisation of the running of the oscillating resonator 2 at the nominal frequency N0 thereof by these running monitoring means 800, before allowing a fine adjustment of the state of the watch 1.

Thus, more particularly, in the event of activation of the automatic winding mechanism 304, the control means 900 are arranged to await the determination of the stabilisation of the running of the oscillating resonator 2 at the nominal frequency N0 thereof by the running monitoring means 800, before activating the state correction device 300 for the fine adjustment of the state of the watch 1 with reference to the reference clock 1001.

When the universal device 1000 comprises a state correction device 300 with state control means 302, these state control means 302 are advantageously interfaced with running measurement means 203 for measuring the running deviation of a watch 1. Also, these state control means 302 are then arranged to control a running setting of the oscillating resonator 2 of this watch 1, and to control an excitation oscillation generated by a master oscillator 201 at an excitation frequency NE, approximately equal to the nominal frequency N0 of the watch 1, or to a whole multiple thereof, with a master running deviation value AM relative to a reference 202, which is less than the initial running deviation value DI of the watch 1. Also, in the event of activation of the automatic winding mechanism 304, the control means 900 are arranged to control on the state control means 302 the triggering of a running setting of the oscillating resonator 2. More particularly, the same oscillator forms both the state correction oscillator 301 and the master oscillator 201.

Particularly, the rewinding and state correction means comprise at least one robotic manipulator 306 for handling a state setting organ of a watch 1 accessible to the user, such as a crown, bezel, or similar. This robotic manipulator 306 is advantageously arranged for handling a cap closing with gripping this state setting organ, or for gripping a peripheral groove comprised by this state setting organ.

In an alternative embodiment, the automatic winding mechanism 304 comprises at least one robotic manipulator 306 for recharging power storage means 5 with power, comprised by the watch 1, by direct handling of a rewinding organ accessible to the user, such as a crown, bolt, button, or similar, or for handling a cap closing with gripping this rewinding organ.

In an alternative embodiment, the automatic winding mechanism 304 for a mechanical or automatic watch is motorised, and suitable for performing automatic rewinding of an automatic watch by setting in motion the watch 1 and the oscillating mass thereof, and/or by magnetic drive of the oscillating mass thereof.

When the universal device 1000 comprises a state correction device 300 with state control means 302, these state control means 302 are advantageously arranged to generate, if the state deviation with the reference clock 1001 is less than one minute, the oscillation of the state correction oscillator 301 to return the state of the watch to the value of the reference clock 1001, or, if the state deviation with the reference clock is greater than one minute, the handling of a robotic manipulator 306 on a state setting organ of a watch 1 accessible to the user, for adjusting the state of the watch 1.

When the state control means 302 are interfaced with running measurement means 203, the latter comprise, in an advantageous alternative embodiment, at least one microphone 1003 for assessing the frequency, running, and amplitude of the oscillating resonator 2. Also, in the event of the observation of a running deviation greater than a predetermined threshold, the state control means 302 are arranged to control at least one excitation oscillation generated by the master oscillator 201 at the excitation frequency NE, to return the running deviation to an intermediate value between the master value AM and the initial running deviation value DI.

Patent applications CH00624/18 and EP3422119 describe further particular features, which relate to various embodiments and alternative embodiments of the cited devices, directly applicable to and integrable in the universal device according to the present invention.

Similarly, the invention advantageously applies to a watch bank 2000, which may be a user's collection, or the stock of a retail store, or other.

Such a watch bank 2000 advantageously comprises such a universal winding and time-setting device 1000 described above, and at least one watch 1. This at least one watch 1 comprises a time base comprising at least one oscillating resonator 2, state correction means by means of a control rod provided with a state setting organ of a watch 1 accessible to the user, such as a crown, bezel or similar, power storage means 5 or at least one barrel, and power recharging means 6.

More particularly, these power recharging means 6 comprise an automatic rewinding mechanism comprising at least one oscillating mass 7 and/or a manual rewinding mechanism by means of the control rod or by means of a winding mechanism 8 comprising a rewinding organ accessible to the user.

More particularly, at least one watch 1 of this watch bank 2000 comprises, for the automatic recharging thereof with power, a groove about the rewinding organ thereof, and/or a cap arranged to cap with gripping this rewinding organ to allow the translational and/or rotational handling thereof by a robotic manipulator 306.

More particularly, the power recharging means 6 comprise an automatic rewinding mechanism comprising at least one mobile component inside the case of a watch 1 and arranged to be driven contactlessly by contactless drive means comprised by the automatic winding mechanism 304 or the support 305, or by a magnetic or electrostatic field.

According to the invention, at least one watch 1 of the watch bank 2000 comprises a removable watch cap, of complementary internal profile to a state setting organ or to a rewinding organ or to an actuator 10, accessible to the user, comprised by the watch 1, which removable cap is hinged and/or elastically deformable between a first presentation position where the removable cap is radially or frontally insertable on a state setting organ or on a rewinding organ or on an actuator 10, and a second gripping position where the removable cap is suitable for closing the state setting organ or the rewinding organ or the actuator 10 with longitudinal and/or radial gripping. Also, this removable cap comprises external gripping means 11, which are arranged, in the second gripping position thereof, to allow the handling thereof in all the degrees of freedom by a robotic manipulator 306.

More particularly, each watch 1 comprised by the watch bank 2000 comprises, for the automatic state setting thereof, a groove about a state setting organ thereof, and/or a cap arranged to cap with gripping a state setting organ accessible to the user to allow the translational and/or rotational handling thereof by a robotic manipulator 306.

Here again, patent applications CH00624/18 and EP3422119 describe further particular features, which relate to various embodiments and alternative embodiments of the cited devices, directly applicable to and integrable in the watch bank according to the present invention.

Also similarly, the invention relates to a method for adjusting the state of a watch 1 of such a watch bank 2000: a removable cap suitable for a state setting organ or for an actuator 10 of the watch 1 is identified, this state setting organ or this actuator 10 is pulled (or compressed depending on the case), the state setting organ of the actuator 10 is equipped with the removable cap, the watch 1 is placed on a support 305 of the universal winding and time-setting device 1000, an action is carried out on a control means 18 to activate the state measurement means 303 and make a state measurement of the watch 1, and the state of the watch 1 is adjusted by the robotic manipulator 306 controlled by the state control means 302.

Here again, patent applications CH00624/18 and EP3422119 describe further particular features, which relate to various embodiments and alternative embodiments of the cited devices, directly applicable to and integrable in this adjustment method according to the present invention.

The invention claimed is:

1. A device (1000) for the winding and time-setting of a watch (1) comprising an oscillating resonator (2) arranged to generate an oscillation at a nominal frequency N0 and comprising a removable cap, of complementary internal profile to a state setting organ or to a rewinding organ or to an actuator (10), accessible to the user, comprised by said watch (1), said device (1000) comprising means for rewinding and correcting the state of said watch (1), comprising an automatic winding mechanism (304) for a mechanical or automatic watch which comprises at least one watch reception support (305), said device (1000) comprising state measurement means (303) for measuring the state of said watch (1) relative to a reference clock (1001) to which refer said state measurement means (303) which comprise a viewing system (1002), where said device (1000) comprises stoppage monitoring means (500) arranged to observe the stoppage or running of ft said oscillating resonator (2) of a watch (1), and control means (900) which are arranged, upon the observation of a stoppage by said stoppage monitoring means (500), to identify according to data transmitted by said state measurement means (303) the stoppage time displayed by said watch (1) in the stoppage position thereof, and to compute the time remaining until a synchronisation between the actual time indicated by said reference clock (1001) and said stoppage time, and, when said remaining time has elapsed, to activate said automatic winding mechanism (304) for rewinding the power storage means of said watch (1), wherein at least one said watch (1) comprises a removable watch cap, of complementary internal profile to a state setting organ or to a rewinding organ or to an actuator (10), accessible to the user, comprised by said watch (1), which removable cap is hinged and/or elastically deformable between a first presentation position where said removable cap is radially or frontally insertable on a state setting organ or on a rewinding organ or on an actuator (10), and a second gripping position where the removable cap is suitable for closing said state setting organ or said rewinding organ or said actuator (10) with longitudinal and/or radial gripping, and wherein said removable cap comprises external gripping means (11), arranged, in the second gripping position thereof, to allow the handling thereof in all the degrees of freedom.

2. The device (1000) according to claim 1, wherein said device (1000) comprises at least one state correction device (300) for correcting the state of said watch (1), comprising said automatic winding mechanism (304), said support (305) whereof is subjected to the oscillations or movements generated by a state correction oscillator (301) arranged to generate an oscillation at a correction frequency NC, and to subject said watch (1) to an oscillation at said correction frequency NC and/or to a modulated movement, said state correction device (300) comprising state control means (302) arranged to control the oscillation of said state correction oscillator (301) and interfaced with said state measurement means (303).

3. The device (1000) according to claim 2, wherein said device (1000) comprises running monitoring means (800) of said oscillating resonator (2), and wherein in the event of activation of the automatic winding mechanism (304), said control means (900) are arranged to await the determination of the stabilisation of the running of said oscillating resonator (2) at the nominal frequency N0 thereof by said running monitoring means (800), before allowing an adjustment of the state of said watch (1), and wherein, in the event of activation of the automatic winding mechanism (304), said control means (900) are arranged to await the determination of the stabilisation of the running of said oscillating resonator (2) at the nominal frequency N0 thereof by said running monitoring means (800), before activating said state correction device (300) for the adjustment of the state of said watch (1) with reference to the reference clock (1001).

4. The device (1000) according to claim 2, wherein said state control means (302) are interfaced with running measurement means (203) for measuring the running deviation of a watch (1), and are arranged to control a running setting of the oscillating resonator (2) of this watch (1), and to control an excitation oscillation generated by a master oscillator (201) at an excitation frequency NE, equal to the nominal frequency N0 of the watch 1, or to a whole multiple thereof, with a master running deviation value AM relative to a reference (202), which is less than the initial running deviation value DI of the watch (1), and wherein in the event of activation of said automatic winding mechanism (304), said control means (900) are arranged to control on said state control means (302) a running setting of said oscillating resonator (2).

5. The device (1000) according to claim 4, wherein the same oscillator forms said state correction oscillator (301) and said master oscillator (201).

6. The device (1000) according to claim 4, wherein said running measurement means (203) comprise at least one microphone (1003) for assessing the frequency, running, and amplitude of said oscillating resonator (2), and that, in the event of the observation of a running deviation greater than a predetermined threshold, said state control means (302) are arranged to control at least one said excitation oscillation generated by said master oscillator (201) at said excitation frequency NE, to return said running deviation to an intermediate value between said master value AM and said initial running deviation value DI.

7. The device (1000) according to claim 2, wherein said rewinding and state correction means comprise at least one robotic manipulator (306) for handling a state setting organ of a watch (1) accessible to the user, which is arranged for handling a cap closing with gripping said state setting organ, or to grip a peripheral groove comprised by said state setting organ.

8. The device (1000) according to claim 2, wherein said state control means (302) are arranged to generate, if the state deviation with said reference clock (1001) is less than one minute, the oscillation of said state correction oscillator (301) to return the state of said watch to the value of said reference clock (1001), or, if the state deviation with said reference clock is greater than one minute, the handling of a robotic manipulator (306) on a state setting organ of a watch (1) accessible to the user, for adjusting the state of said watch (1).

9. A watch bank (2000) comprising a device (1000) according to claim 2, and at least one said watch (1) comprising a time base comprising at least one oscillating resonator (2), state correction means by means of a control rod provided with a state setting organ of a watch (1) accessible to the user, power storage means (5) or at least one barrel, and power recharging means (6), wherein said power recharging means (6) comprise an automatic rewinding mechanism comprising at least one oscillating mass (7) and/or a manual rewinding mechanism by means of said control rod or by means of a winding mechanism (8) comprising a rewinding organ accessible to the user.

10. A watch bank (2000) according to claim 9, wherein at least one said watch (1) comprises, for the automatic recharging thereof with power, a groove about said rewinding organ and/or a cap arranged to cap with gripping said rewinding organ to allow the translational and/or rotational handling thereof by a robotic manipulator (306).

11. A watch bank (2000) according to claim 9, wherein said power recharging means (6) comprise an automatic rewinding mechanism comprising at least one mobile component inside the case of a watch (1) and arranged to be driven contactlessly by contactless drive means comprised by said automatic winding mechanism (304) or said support (305), or by a magnetic or electrostatic field.

12. A watch bank (2000) according to claim 9, wherein each said watch (1) comprised by said watch bank (2000) comprises, for the automatic state setting thereof, a groove about a state setting organ thereof, and/or a cap arranged to cap with gripping said state setting organ accessible to the user to allow the translational and/or rotational handling thereof by a robotic manipulator (306).

13. A method for adjusting the state of said watch (1) of said watch bank (2000) according to claim 9, wherein said removable cap suitable for said state setting organ or for said actuator (10) of said watch (1) is identified, wherein said state setting organ or said actuator (10) is pulled, wherein said state setting organ of said actuator (10) is equipped with said removable cap, that said watch (1) is placed on said support (305) of said winding and time-setting device (1000), wherein an action is carried out to activate said state measurement means (303) and make a state measurement of said watch (1), and wherein the state of said watch (1) is adjusted by a robotic manipulator (306) controlled by said state control means (302).

14. The device (1000) according to claim 1, wherein said device (1000) comprises running monitoring means (800) of said oscillating resonator (2), and wherein in the event of activation of the automatic winding mechanism (304), said control means (900) are arranged to await the determination of the stabilisation of the running of said oscillating resonator (2) at the nominal frequency N0 thereof by said running monitoring means (800), before allowing an adjustment of the state of said watch (1).

15. The device (1000) according to claim 1, wherein said automatic winding mechanism (304) comprises at least one robotic manipulator (306) for recharging power storage means (5) with power, comprised by said watch (1), by handling of a rewinding organ accessible to the user, or of a cap closing with gripping said rewinding organ.

16. The device (1000) according to claim 1, wherein said automatic winding mechanism (304) for a mechanical or automatic watch is motorised and suitable for performing automatic rewinding of an automatic watch by setting in motion said watch (1) and the oscillating mass thereof, and/or by magnetic drive of the oscillating mass thereof.

* * * * *